US009556657B2

(12) United States Patent
Yi et al.

(10) Patent No.: US 9,556,657 B2
(45) Date of Patent: Jan. 31, 2017

(54) HINGE FOR REFRIGERATOR AND METHOD FOR MANUFACTURING THE SAME

(71) Applicant: LG ELECTRONICS INC., Seoul (KR)

(72) Inventors: Myeongha Yi, Seoul (KR); Jongshin Lee, Seoul (KR); Hanhyo Kim, Seoul (KR); Raeyoung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/744,591

(22) Filed: Jun. 19, 2015

(65) Prior Publication Data

US 2015/0368944 A1 Dec. 24, 2015

(30) Foreign Application Priority Data

Jun. 20, 2014 (KR) ..... 10-2014-0075872

(51) Int. Cl.
*E05D 9/00* (2006.01)
*E05D 5/02* (2006.01)
(Continued)

(52) U.S. Cl.
CPC ..... *E05D 5/0276* (2013.01); *B21D 53/40* (2013.01); *E05D 5/04* (2013.01); *E05D 5/046* (2013.01);
(Continued)

(58) Field of Classification Search
CPC .... Y10T 16/539; Y10T 16/558; F25D 23/028; F25D 23/02; F25D 2323/024; F25D 2323/02
(Continued)

(56) References Cited

U.S. PATENT DOCUMENTS 3,065,498 A * 11/1962 Johnson ..... E05D 1/04 16/359
3,290,109 A * 12/1966 Vanegas ..... E05D 7/04 312/326
(Continued)

FOREIGN PATENT DOCUMENTS

DE 10 2010 039743 3/2012
KR 1999-0014966 A 5/1999
(Continued)

OTHER PUBLICATIONS

Extended European Search Report issued in European Application No. 15170453.3 on Oct. 26, 2015, 3 pages.

*Primary Examiner* — Janet M Wilkens
(74) *Attorney, Agent, or Firm* — Fish & Richardson P.C.

(57) ABSTRACT

A hinge for a refrigerator includes a hinge support configured to be mounted on a front surface of a cabinet of the refrigerator, where the hinge support has a plate shape and defining a coupling hole, a hinge bracket including an insertion part configured to be inserted into the coupling hole, where the hinge bracket is coupled to the hinge support along a longitudinal direction of the hinge support, and a hinge pin that is configured to mount to the hinge bracket and that is configured to allow a door of the refrigerator to rotate about the hinge pin. The hinge support includes a bracket support that at least partially surrounds the coupling hole and protrudes from a front surface of the hinge support, the bracket support being configured to provide support to the hinge support.

12 Claims, 11 Drawing Sheets

(51) Int. Cl.
*F25D 23/02* (2006.01)
*B21D 53/40* (2006.01)
*E05D 5/04* (2006.01)

(52) U.S. Cl.
CPC ..... *F25D 23/028* (2013.01); *E05D 9/00* (2013.01); *E05Y 2900/31* (2013.01); *F25D 2323/024* (2013.01); *Y10T 16/554* (2015.01); *Y10T 29/25* (2015.01)

(58) Field of Classification Search
USPC ..... 248/290.1, 240; 312/326–329, 405
See application file for complete search history.

(56) References Cited

U.S. PATENT DOCUMENTS 5,156,096 A * 10/1992 Lamprey ..... A47B 96/027 108/108
5,871,229 A * 2/1999 Saito ..... B60R 21/2165 280/728.3
6,030,064 A 2/2000 Kim
8,491,070 B2 * 7/2013 Davis ..... F25D 23/028 312/326
2006/0017361 A1 * 1/2006 Rendel ..... E05D 11/0081 312/405
2010/0231110 A1 * 9/2010 Choi ..... E05D 5/02 312/405
2012/0080989 A1 * 4/2012 Davis ..... F25D 23/028 312/405
2013/0249371 A1 * 9/2013 Lively ..... F25D 23/028 312/404
2014/0333191 A1 * 11/2014 Sun ..... F25D 23/00 312/404

FOREIGN PATENT DOCUMENTS

KR 10-2005-0095265 A 9/2005
KR 10-0631459 B1 10/2006
KR 10-2012-0009144 A 2/2012
WO WO 2004109045 * 12/2004
WO 2008/119641 10/2008

* cited by examiner

HINGE FOR REFRIGERATOR AND METHOD FOR MANUFACTURING THE SAME

CROSS-REFERENCE TO RELATED APPLICATIONS

The application claims priority under 35 U.S.C. §119 and 35 U.S.C. §365 to Korean Patent Application No. 10-2014-0075872 filed on Jun. 20, 2014, whose entire disclosure is hereby incorporated by reference.

FIELD

The present disclosure relates to a hinge for a refrigerator and a method for manufacturing the same.

BACKGROUND

Refrigerators are electric appliances that can store foods at low temperature in an inner storing space closed by a refrigerator door. Typically, the storing space is cooled using cool air that is generated by heat-exchanging with a refrigerant circulating a refrigeration cycle to store the foods in an optimal state.

In recent years, refrigerators have tended to increase in size and to provide multi-functions, and accordingly, refrigerators of various structures in consideration of user convenience have been brought to the market.

In general, doors mounted on the refrigerator may be opened and closed through rotation thereof. For this, each of the doors may be rotatably coupled to a main body defining a storage space by using a hinge. In some cases, a hinge may include a hinge plate fixed to a main body and a hinge pin connecting the hinge plate to a door to serve as a rotation shaft of the door. In some cases, a hinge may include a mounting plate on which a hinge pin is mounted and a vertical flange to which the mounting plate is coupled.

SUMMARY

According to one aspect, a hinge for a refrigerator includes a hinge support configured to be mounted on a front surface of a cabinet of the refrigerator, where the hinge support has a plate shape and defining a coupling hole, a hinge bracket including an insertion part configured to be inserted into the coupling hole, where the hinge bracket is coupled to the hinge support along a longitudinal direction of the hinge support, and a hinge pin that is configured to mount to the hinge bracket and that is configured to allow a door of the refrigerator to rotate about the hinge pin. The hinge support includes a bracket support that at least partially surrounds the coupling hole and protrudes from a front surface of the hinge support, the bracket support being configured to provide support to the hinge support.

Implementations according to this aspect may include one or more of the following features. For example, the hinge support may define a support recess part that is recessed into a rear surface of the hinge support that is opposite of the front surface of the hinge support that includes the bracket support, and the coupling hole may be defined within the support recess part. The hinge support may be made of metal and formed by press processing, and the support recess part may be molded at the same time as the press processing of the hinge support such that the support recess part has a recessed volume corresponding to a protruding volume of the bracket support. An outlet of the coupling hole may include an inclined part that is inclined around an inner circumference of the coupling hole, the outlet of the coupling hole opening toward and being exposed to the support recess part. Based on the insertion part being inserted into the coupling hole, the insertion part may protrude from the outlet of the coupling hole. The bracket support may have an outer surface that is inclined or rounded. The bracket support may define a space in which an end of the hinge bracket is accommodated. The bracket support may gradually decrease in thickness as the bracket support extends in the protruding direction thereof.

Further according to this aspect, the hinge support may define a fastening hole through which a fastening member is configured to pass through, a tapered part may have an inner diameter that gradually decreases from an inlet to an outlet thereof is disposed on an inner circumferential surface of the fastening hole, and a seating surface having an inclination corresponding to the tapered part may be provided on the fastening member. The fastening hole may include a main fastening hole disposed on one side of the bracket support and a sub fastening hole disposed on each of upper and lower sides of the bracket support. The hinge bracket may define a pin insertion hole into which the hinge pin is configured to be inserted from an upper side of the pin insertion hole, and a bottom surface of the hinge bracket may define a bracket recess part recessed to be disposed inside the pin insertion hole.

According to another aspect, a method for manufacturing a hinge for a refrigerator includes processing a hinge support and hinge bracket, wherein the hinge support is configured to be fixedly mounted on a cabinet and includes a coupling hole and a bracket support, and the hinge bracket includes an insertion part configured to be inserted into the coupling hole and has one end configured to be inserted into the bracket support, temporarily assembling the hinge bracket and the hinge support such that the hinge bracket is coupled to the hinge support along a longitudinal direction of the hinge support, pressing and fixing the hinge bracket, wherein a rear end of the insertion part protruding to a rear side of the coupling hole is pressed to be closely attached to an inclined part disposed along a circumferential surface of the coupling hole, thereby fixing the hinge bracket to the hinge support, and performing surface treatment to plate or paint surfaces of the hinge support and the hinge bracket that are coupled to each other.

Implementations according to this aspect may include one or more of the following features. For example, processing the hinge support may include molding the hinge support by using press processing, and molding the hinge support may include molding a support recess part that is recessed from a back surface of the hinge support, wherein the bracket support is molded to protrude from a front surface of the hinge support such that the protruding volume of the bracket support corresponds to a recessed volume of the support recess part. The method may further include pressing and deforming a rear end of the insertion part such that the rear end does not further protrude beyond the support recess part. Processing the hinge bracket may include molding the hinge bracket, and molding the hinge bracket may include forming, at a top surface of the hinge bracket, a pin insertion hole into which a hinge pin is configured to be inserted, and forming, on a bottom surface of the hinge bracket, a stepped part in which the pin insertion hole is accommodated, as well as, after the hinge pin is inserted into the pin insertion hole, fixing the hinge pin to the hinge bracket at the stepped part through welding or riveting.

According to yet another aspect, a refrigerator includes a cabinet, one or more doors, and a hinge. The hinge includes a hinge support configured to be mounted on a front surface of a cabinet of the refrigerator, where the hinge support has a plate shape and defining a coupling hole, a hinge bracket including an insertion part configured to be inserted into the coupling hole, where the hinge bracket is coupled to the hinge support along a longitudinal direction of the hinge support, and a hinge pin that is configured to mount to the hinge bracket and that is configured to allow a door of the refrigerator to rotate about the hinge pin. The hinge support includes a bracket support that at least partially surrounds the coupling hole and protrudes from a front surface of the hinge support, the bracket support being configured to provide support to the hinge support.

The details of one or more implementations are set forth in the accompanying drawings and the description below. Other features will be apparent from the description and drawings, and from the claims.

BRIEF DESCRIPTION OF THE DRAWINGS

The implementations will be described in detail with reference to the following drawings in which like reference numerals refer to like elements wherein.

DETAILED DESCRIPTION

Reference will now be made in detail to the implementations of the present disclosure, examples of which are illustrated in the accompanying drawings.

For convenience of description and understanding of a refrigerator according to an implementation, although a bottom freezer type refrigerator in which a pair of doors are disposed on left and right sides of a refrigerating compartment is described as an example, the present disclosure is not limited thereto. For example, the current implementation may be applied to all types of refrigerators in which doors are rotatably mounted through a hinge.

Figure 1:
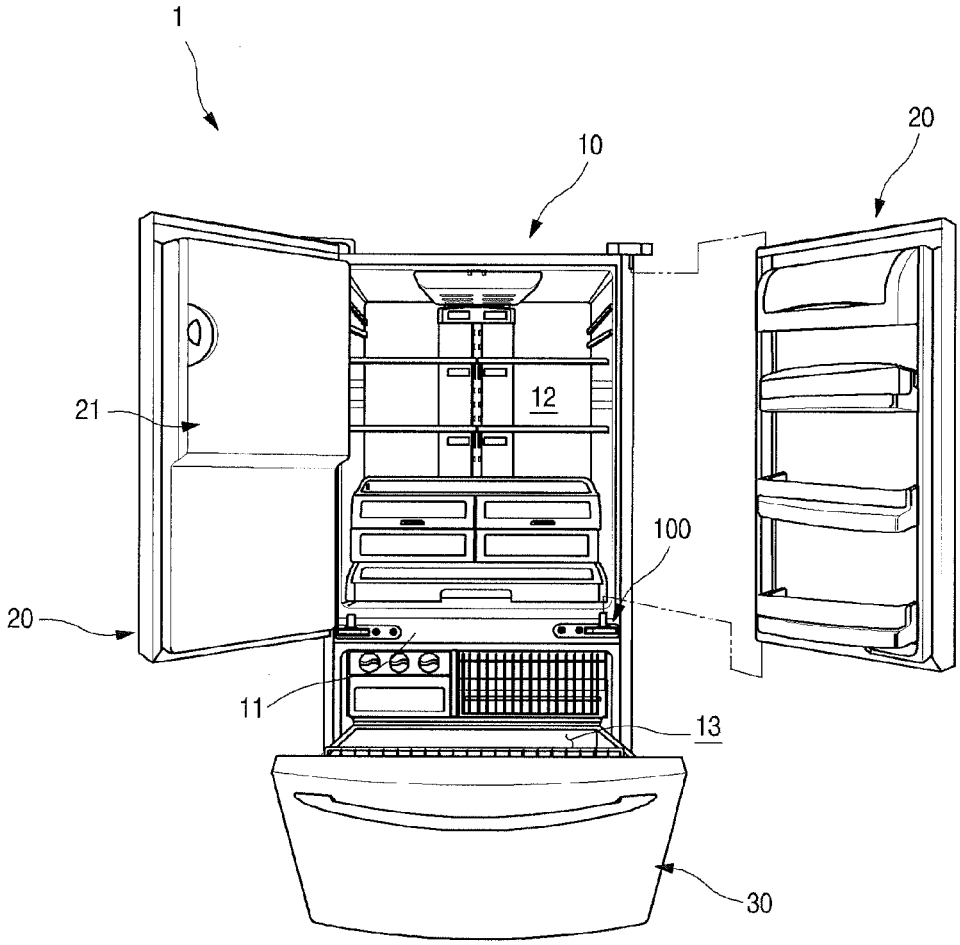
FIG. 1 is a perspective view showing an example refrigerator having a mounting structure of a refrigerator hinge.

Referring to FIG. 1, a refrigerator 1 according to an implementation includes a cabinet 10 defining a storage space and doors 20 and 30 disposed on a front surface of the cabinet 10 to open and close the storage space. Here, an outer appearance of the refrigerator 1 may be defined by the cabinet 10 and the doors 20 and 30.

The storage space within the cabinet 10 may be vertically partitioned by a barrier 11 to define a refrigerating compartment 12 at an upper side and a freezing compartment 13 at a lower side of the cabinet 10. Also, a plurality of shelves and drawers may be disposed inside the freezing compartment 13 and the refrigerating compartment 12 to accommodate foods.

The doors 20 and 30 may include a refrigerating compartment door 20 for opening/closing the refrigerating compartment 12 and a freezing compartment door 30 for opening/closing the freezing compartment 13. The freezing compartment door 30 may be disposed on a front surface of the freezing compartment 13. The freezing compartment door 30 may be inserted into or withdrawn from the freezing compartment 13 like a drawer. Also, the refrigerating compartment door 20 may be provided in a pair on both left and right sides of a front surface of the refrigerating compartment 12. The pair of refrigerating compartment doors 20 may be independently rotatably mounted to open/close the refrigerating compartment 12.

An ice making device 21, a dispenser, and various baskets for accommodating foods may be disposed on the refrigerating compartment door 20.

Each of upper and lower ends of the refrigerator door 20 may be coupled to the cabinet 10 by using a hinge. Here, the refrigerator door 20 may be rotatably mounted by using the hinge as a rotation shaft. The hinge may include an upper hinge that connects the upper end of the refrigerating compartment door 20 to an upper end of the cabinet 10 and an intermediate hinge 100 that connects the lower end of the refrigerating compartment door 20 to the front surface of the cabinet 10.

Hereinafter, the intermediate hinge 100 supporting the refrigerator door 20 will be described in detail. For convenience of description and understanding, the "refrigerating compartment door 20" will be referred to as a "door 20", and the "intermediate hinge 100" will be referred to as a "hinge 100".

Referring to FIGS. 2 to 6, the hinge 100 may include a hinge support 200 fixedly mounted on the front surface of the cabinet 10, a hinge pin 400 inserted into a lower end of the door 20 to serve as a rotation shaft, and a hinge bracket 300 on which the hinge pin 400 is mounted and being coupled to the hinge support 200 to support the door 20.

Figure 2:
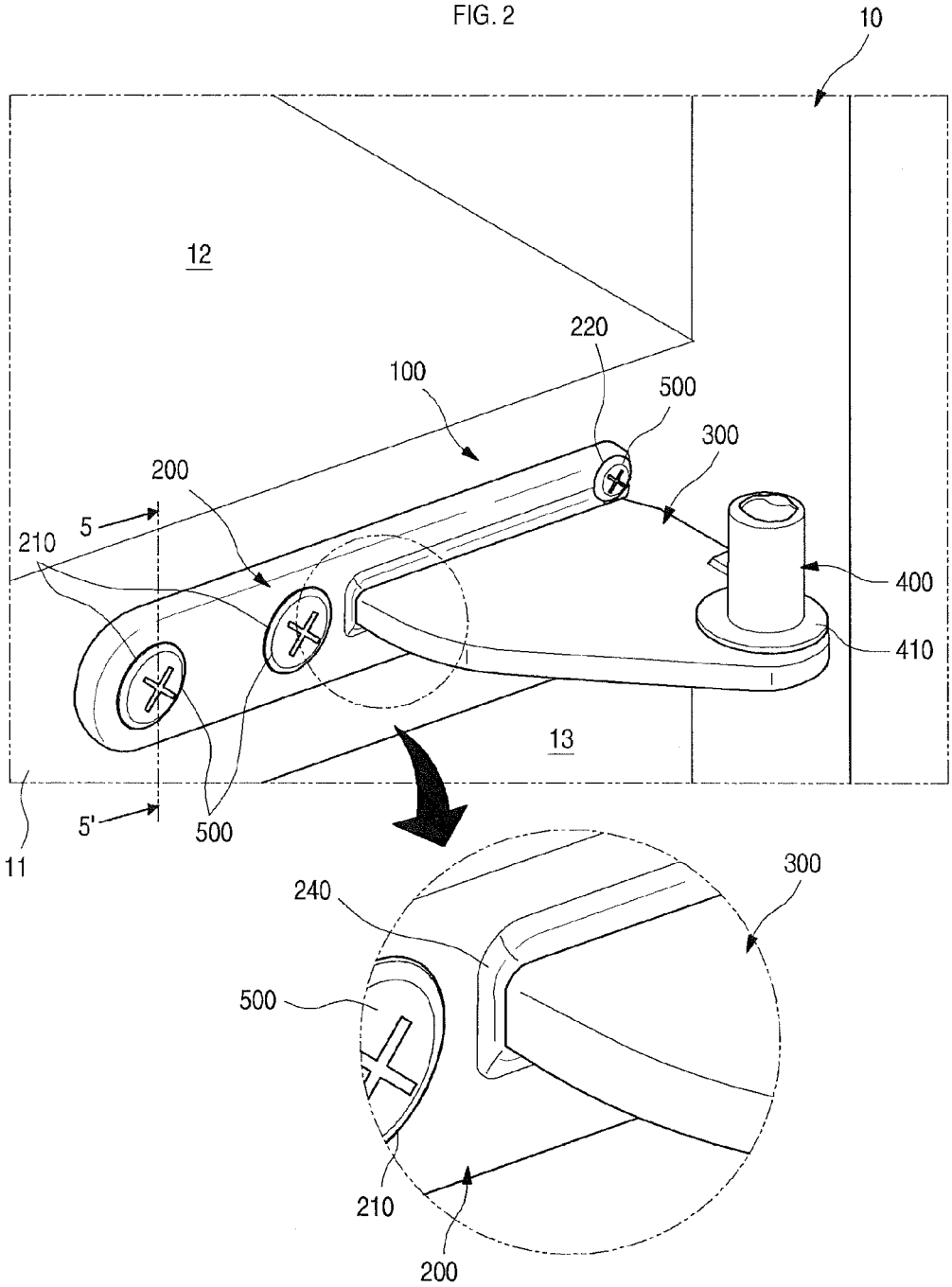
FIG. 2 is a perspective view illustrating an assembled state of the example refrigerator hinge of FIG. 1.
Figure 3:
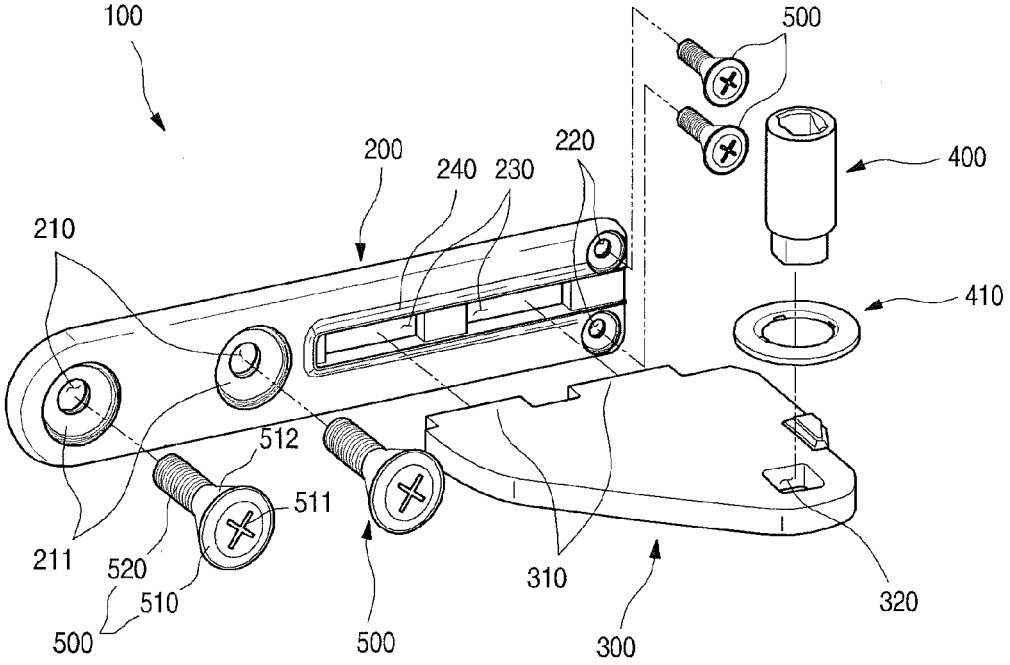
FIG. 3 is a front exploded perspective view showing the refrigerator hinge.
Figure 4:
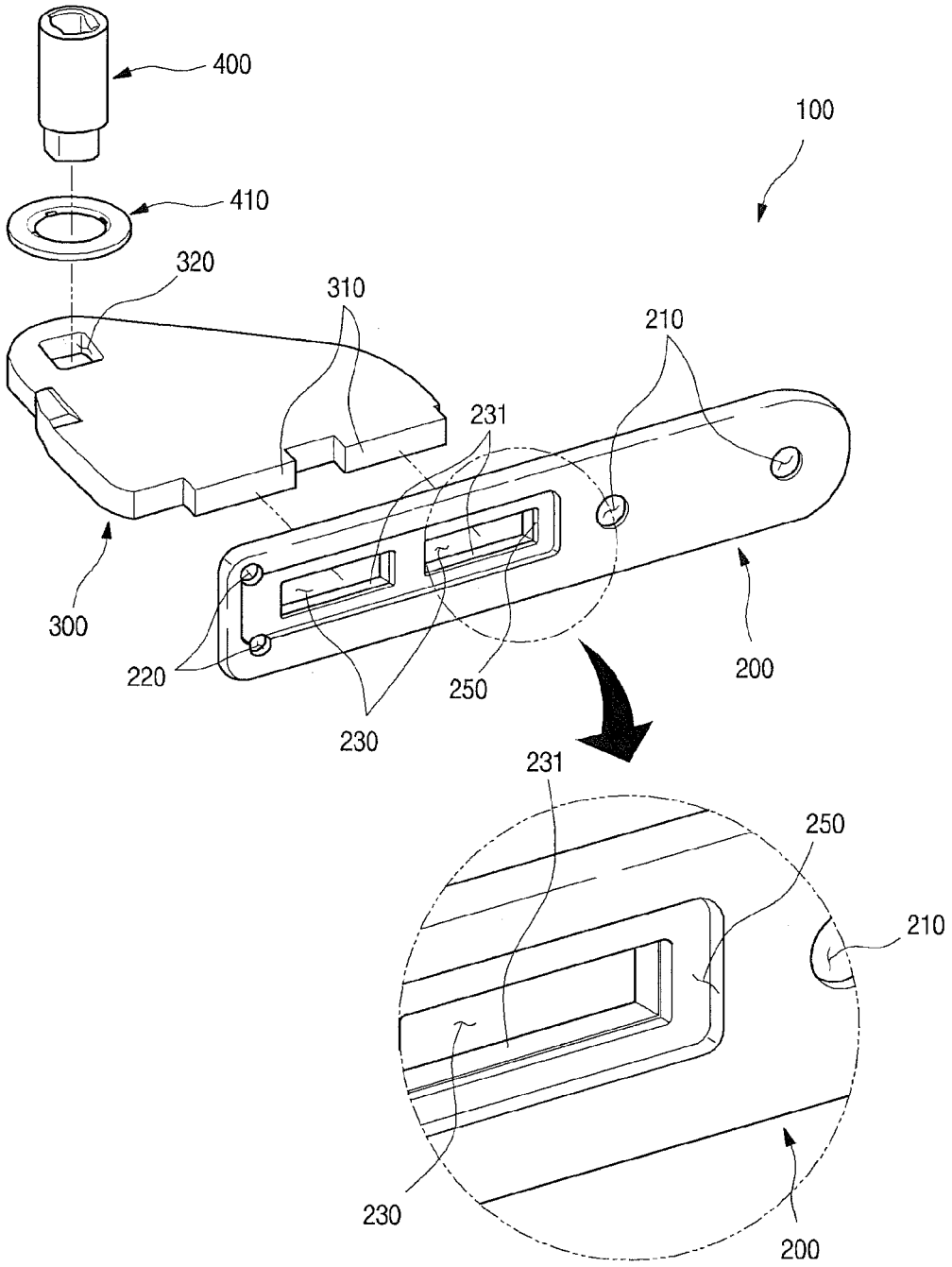
FIG. 4 is a rear exploded perspective view showing the refrigerator hinge.
Figure 5:
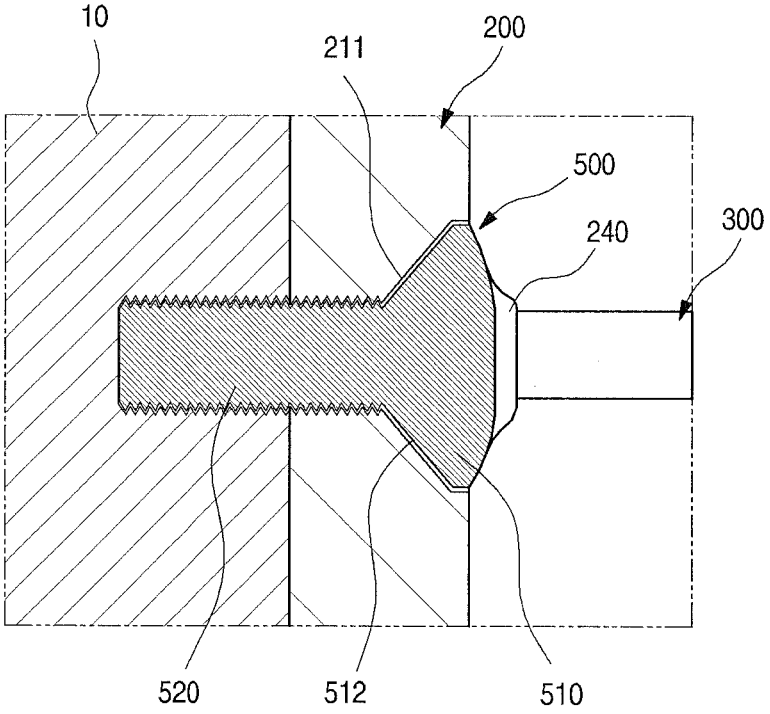
FIG. 5 is a cross-sectional view of the refrigerator hinge taken along line 5-5' of FIG. 2.
Figure 6:
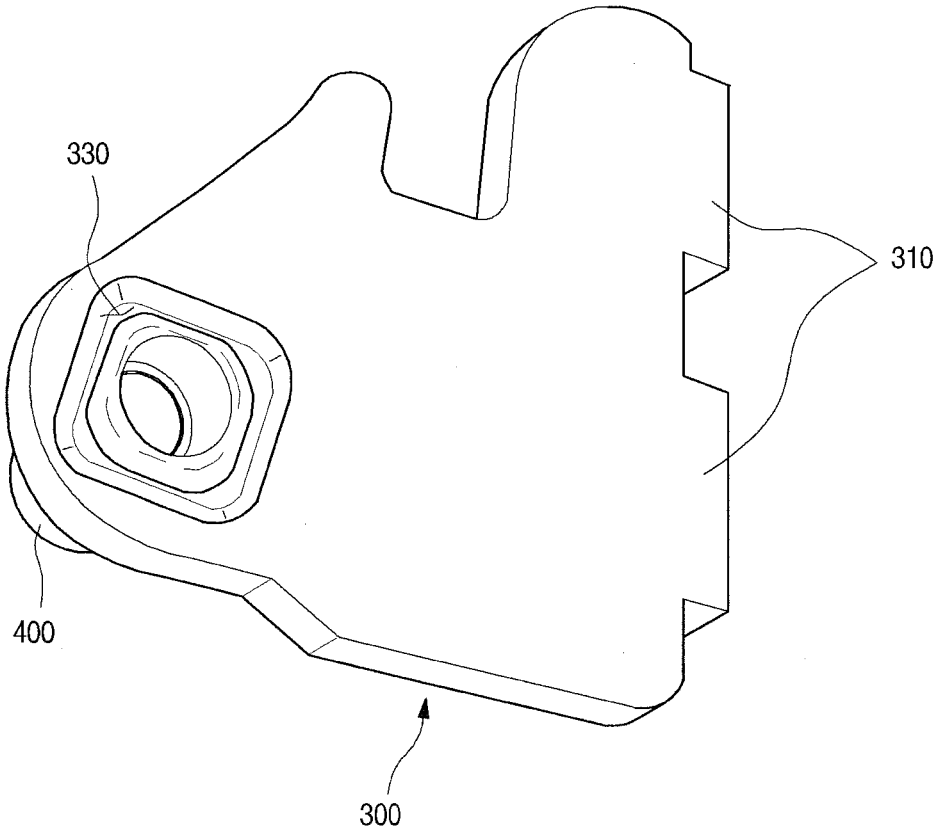
FIG. 6 is a perspective view illustrating a state in which a hinge bracket and a hinge pin are coupled to each other.

The hinge support 200 may be provided as a metal plate having a predetermined thickness. The hinge support 200 may vary in thickness according to a weight of the door 20. The hinge support 200 may be attached to the front surface of the cabinet, which corresponds to the lower end of the door 20. As shown in FIG. 2, the hinge support 200 may be mounted on a front surface of the barrier 11.

The hinge support 200 may have an outer circumference that is molded to be rounded by press processing. Also, the hinge support 200 may have a plurality of fastening holes 210 and 220 and a coupling hole 230. The hinge support 200 may define the whole outer appearance of the hinge 100.

In detail, the fastening holes 210 and 220 may be defined in the hinge support 200 to fixedly mount the hinge support 200 on the cabinet 10. The fastening holes 210 and 220 may include main fastening holes 210 arranged in a horizontal direction along a longitudinal direction of the hinge support 200 and sub fastening holes 220 arranged in a vertical direction.

The plurality of main fastening holes 210 may be defined in one side, in which the coupling hole 230 is defined, at a predetermined distance. Also, an end of the one side of the hinge support 200 in which the main fastening holes 210 are defined may be rounded along the configuration of each of the main fastening holes 210.

The main fastening hole 210 may have an outlet having an inner diameter less than that of an inlet thereof. Thus, a tapered part 211 having a shape that is gradually inclined from the inlet to the outlet may be provided in the main fastening hole 210. When the hinge support 200 has thicknesses different from each other, the hinge support 200 may have the same inclination. Thus, a fastening member 500 fastened to the main fastening holes may be closely attached and fixed regardless of the thickness of the hinge support 200.

Also, the sub fastening hole 220 may be disposed on the other side of the hinge support 200 in which the coupling hole 230 is defined. The sub fastening hole 220 may be defined above and below the coupling hole 230. Here, the sub fastening holes 220 may be defined in upper and lower edges of the hinge support 200. Each of the sub fastening holes 230 may have a size that does not interfere with the coupling hole 230. Also, the sub fastening hole 220 may have a size slightly less than that of the main fastening hole 210. However, the fastening hole 220 and the main fastening hole 210 may have the same structure and configuration except for the size and position thereof. Also, the sub fastening hole 220 may have an inner surface having the same configuration as the tapered part 211.

The fastening member 500 may be fastened to the main fastening hole 210 and the sub fastening hole 220 to allow the hinge support 200 to be fixedly mounted on the front surface of the cabinet 10. The fastening member 500 may pass through each of the main fastening hole 210 and the sub fastening hole 220 and then be fastened to the cabinet 10.

In detail, the fastening member 500 may include a head part 510 seated on the fastening holes 210 and 220 and a fastening part 520 passing through the fastening holes 210 and 220 and fixedly fastened to the cabinet 10.

Also, a tool groove 511 that is configured to be manipulated to be fastened by using a tool such as screwdriver may be defined in a front surface of the head part 510 that is exposed through an inlet of each of the fastening holes 210 and 220. An inclined seating surface 512 may be disposed on a circumferential of the head part 510.

The seating surface 512 may be inclined to correspond to the tapered part 211 formed in each of the fastening holes 210 and 220. Here, the seating surface 512 may have the same inclination regardless of a size of the fastening member 500.

The fastening part 520 may extend backward from a rear end of the seating surface 512 and may have an inner diameter corresponding to that of an outlet of each of the fastening holes 210 and 220. Also, the fastening part 520 may have a length that is enough to be inserted into and fastened to the cabinet 10. Also, a screw thread may be formed on an outer surface of the fastening part 520.

Thus, in the state where the fastening member 500 is inserted into and fastened to the fastening holes 210 and 220, the seating surface 512 may be closely attached to the tapered part 211, and the fastening part 520 may pass through the fastening holes 210 and 220 and the front surface of the cabinet and then be inserted and fixed.

The seating surface 512 of the fastening member 500 and the tapered part 211 of each of the fastening holes 210 and 220 may have the same inclination regardless of the sizes of the fastening member 500 and the fastening holes 210 and 220. Also, even though the thickness of the hinge support 200 changes according to a support load of the door 20, the hinge support 200 may be fixed by using the same fastening member 500.

However, if the main fastening hole 210 and the sub fastening hole 220 have sizes different from each other, the fastening members 500 having sizes different from each other may be used.

The coupling hole 230 is defined in the hinge support 200. The coupling hole 230 may be defined in a central portion in a vertical width direction of the hinge support 200. Also, the coupling hole 230 may extend in a transverse direction in which the hinge support 200 extends. The coupling hole 230 may have a shape corresponding so that the insertion part 310 disposed on the hinge bracket 300 is inserted into and fixed to the coupling hole 230.

The coupling hole 230 may be defined inside a bracket support 240 and support recess part 250, which will be described below. Also, at least one or more coupling holes 230 may be continuously defined at a predetermined distance.

The bracket support 240 may have a shape protruding to the front surface of the hinge support 200 that is a direction in which the hinge bracket 300 is inserted. Also, the bracket support 240 may be disposed along the outside of the coupling hole 230 up to an end of the coupling hole 230 in a direction that faces the end of the hinge support 200. Thus, the bracket support 240 may have a predetermined space therein. The coupling hole 230 may be defined in the inner space.

The bracket support 240 may have an outer surface that is rounded or inclined to decrease in thickness as the bracket support protrudes. Also, the bracket support 240 may have an inner surface that is closely attached to the outer surface of the hinge bracket 300.

Also, in the state where the hinge support 200 and the hinge bracket 300 are coupled to each other, a portion at which the hinge support 200 and the hinge bracket 300 contact each other by the bracket support 240 may be rounded or inclined to minimize a gap and/or line that may occur when assembled. Thus, when surface treatment such as plating or painting is performed after the hinge support 200 and the hinge bracket 300 are coupled to each other, the surface treatment may be uniformly realized on an entire surface without defects.

The support recess part 250 may be defined in a rear surface of the hinge support 200, which is opposite to the position of the bracket support 240. The support recess part 250 may have a rectangular shape having a predetermined area and be defined in a position corresponding to the bracket support 240.

Here, the support recess part 250 may have a recessed volume equal to a protruding volume of the bracket support 240. That is, when the hinge support 200 is processed by using press processing, a material may protrude by the recessed volume of the support recess part 250 to mold the bracket support 240. Thus, since the support recess part 250 has a depth that is proportional to a protruding height of the bracket support 240, the more the bracket support 240 protrudes, the more the support recess part 250 may be recessed.

Also, the coupling hole 230 may be defined inside the support recess part 250. An insertion part 310 of the hinge bracket 300, which will be described below, may be inserted into and coupled to the coupling hole 230. Also, the coupling hole 230 may be defined in a position that is somewhat spaced apart from both left and right ends of the bracket support 240.

An inclined part 231 may be disposed around an outlet of the coupling hole 230. The inclined part 231 may be disposed on the outlet of the coupling hole, which is exposed to the rear surface of the hinge support. When the insertion part 310 is inserted into the coupling hole 230, a rear end of the insertion part 310 may not further protrude from a height of a back surface of the hinge support 200, but further protrude from the outlet of the coupling hole 230.

In this state, the rear end of the insertion part 310, which is exposed to the outlet of the coupling hole 230, may be pressed by using a presser or compressed through riveting to allow the rear end of the insertion part 310 to be closely attached to the inclined part 231. When the rear end of the hinge bracket is hooked with the hinge support by the above-described structure, the hinge support 200 and the hinge bracket 300 may not be easily separated from each other, but be completely coupled to each other.

The hinge bracket 300 may be provided as a metal plate having a predetermined area. Also, the hinge bracket 300 may have a predetermined thickness to support the door 20. Here, due to the structural feature in which a lower of the door 20 is directly applied, the hinge bracket 300 may have a thickness thicker than that of the hinge support 200.

The whole configuration of the hinge bracket 300 as well as configurations of a pin insertion hole in which the hinge pin 400 is inserted, the bracket recess part 330 for fixing the hinge pin 400, and the insertion part 310 may be molded through press processing.

The insertion part 310 may protrude from one end of the hinge bracket 300 and have a shape corresponding to that of the coupling hole 230. The insertion part 310 may have a rectangular shape in cross-section. In the state where the insertion part 310 is inserted, the insertion part 310 may be closely attached to an inner surface of the coupling hole 230. Also, in the state where the insertion part 310 is inserted into the coupling hole 230, the rear end of the insertion part 310 may be pressed to be closely attached to the inner surface of the coupling hole 230 and the inclined part 231, thereby preventing a gap from occurring therebetween.

In some cases, the pin insertion hole 320 may be a rectangular-shaped hole corresponding to that of the lower end of the hinge pin 400 and pass through the hinge bracket 300. Thus, in the state where the hinge pin 400 is inserted into the pin insertion hole 320, the hinge pin 400 may be fixed and coupled to a rotation shaft of the lower end of the door 20 to serve as a rotation shaft.

In some cases, a washer 410 may be further disposed between the pin insertion hole 320 and the hinge pin 400. The hinge pin 400 may pass through the washer 410. When the hinge bracket 300 is seated, the washer 410 may contact the door or the rotation shaft of the door 20. Thus, the washer 410 may be formed of a material having high abrasion resistance and superior lubrication performance such as engineering plastic so that the door smoothly rotates.

The bracket recess part 330 is defined in a bottom surface of the hinge bracket 300. The bracket recess part 330 may be recessed outside the outlet of the pin insertion hole 320 to accommodate the lower end of the pin insertion hole 320. The bracket recess part 330 may have a rectangular shape like the pin insertion hole 320. The bracket recess part 330 may define a predetermined space outside the pin insertion hole 320.

Thus, in the state where the hinge pin 400 is inserted into the pin insertion hole 320, the lower end of the hinge pin 400 may be cocked or welded within the space of the bracket recess part 330 to fix the hinge pin 400 to the hinge bracket 300. Here, the fixed lower end of the hinge pin 400 may be disposed inside the bracket recess part 330 to prevent the hinge pin 400 from interfering with the other door disposed under the hinge 100.

Hereinafter, a method for manufacturing the hinge having the above-described structure according to an implementation will be described.

Referring to FIGS. 7 to 11, to manufacture a hinge 100 according to one implementation, a hinge support 200, a hinge bracket 300, and a hinge pin 400 are processed. The overall configuration as well as detailed structures of the hinge support 200 and the hinge bracket 300 may be molded by using press processing.

In detail, the press processing may be performed on the hinge support 200 to form a main fastening hole, a sub fastening hole 220, and a coupling hole 230. Also, when a support recess part is molded, a bracket support 240 may also be molded.

Figure 7:
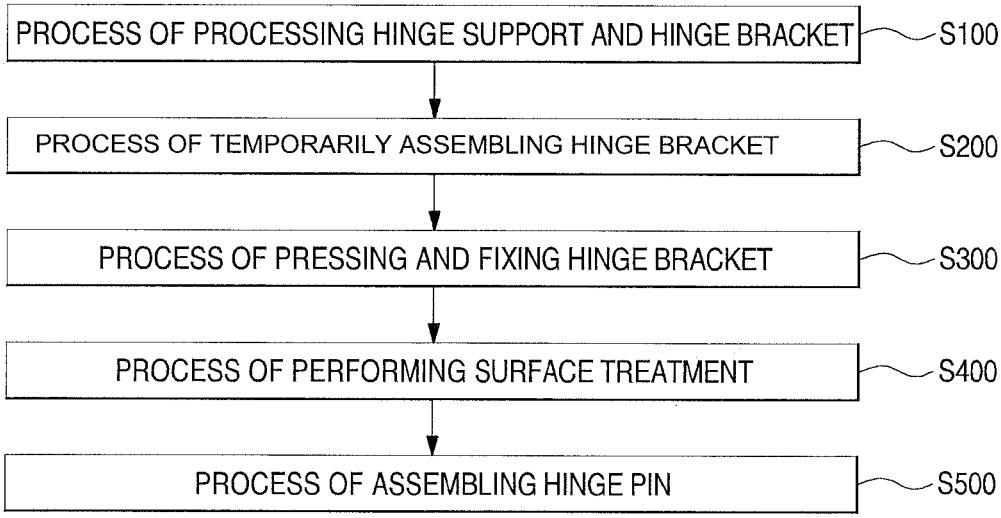
FIG. 7 is a block diagram illustrating an example method for manufacturing the hinge in stages.

Referring to a process (S100) in FIG. 7 of processing a hinge support and a hinge bracket, the press processing may also be performed on the hinge bracket 300 to form a pin insertion hole 320, a bracket recess part 330, and an insertion part 310.

Figure 8:
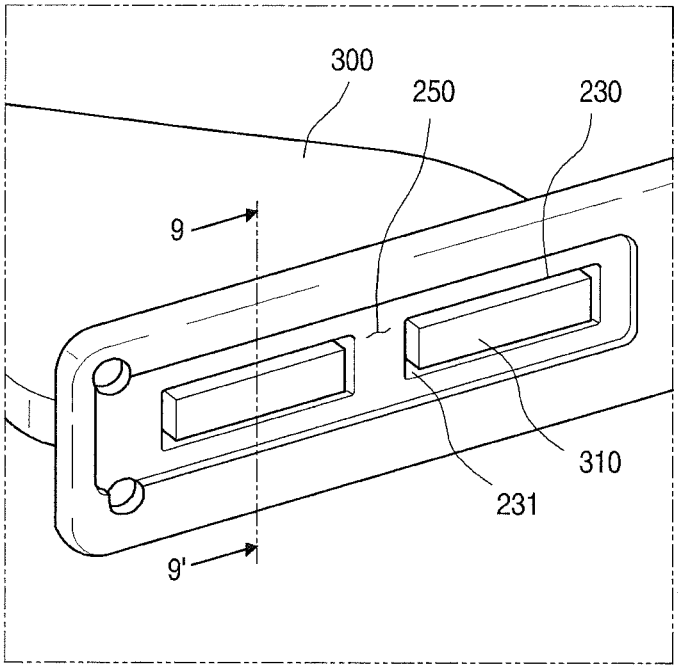
FIG. 8 is a partial perspective view illustrating a temporarily assembled state between the hinge bracket and the hinge support.
Figure 9:
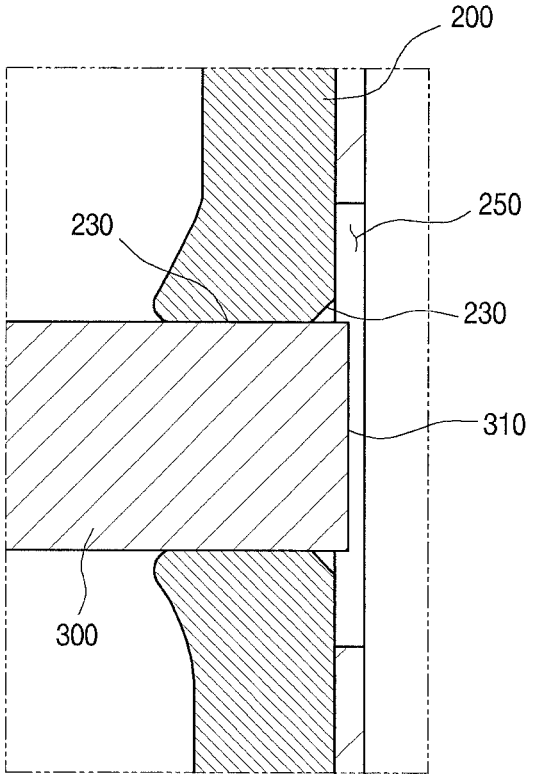
FIG. 9 is a cross-sectional view taken along line 9-9' of FIG. 8.

Further referring to a process (S200) of temporarily assembling the hinge bracket, when the hinge support 200 and the hinge bracket 300 are completely molded, the hinge support 200 and the hinge bracket 300 can be assembled with each other. To achieve this, the insertion part 310 can be inserted into the coupling hole 230. In the state where the insertion part 310 is completely inserted into the coupling hole 230, as illustrated in FIGS. 8 and 9, an end of the hinge bracket 300 including the insertion part 310 is inserted into a space that is formed by the bracket support 240.

Thus, the insertion part 310 may be supported inside the coupling hole 230 and also additionally supported by the bracket support 240. In this state, the insertion part 310 may be closely attached inside the coupling hole 230, and also, the end of the hinge bracket 300 may be closely attached to an inner surface of the bracket support 240. Here, portions, which are adjacent to each other by the bracket support 240, of the hinge support 200 and the hinge bracket 300 may be rounded or inclined.

Figure 10:
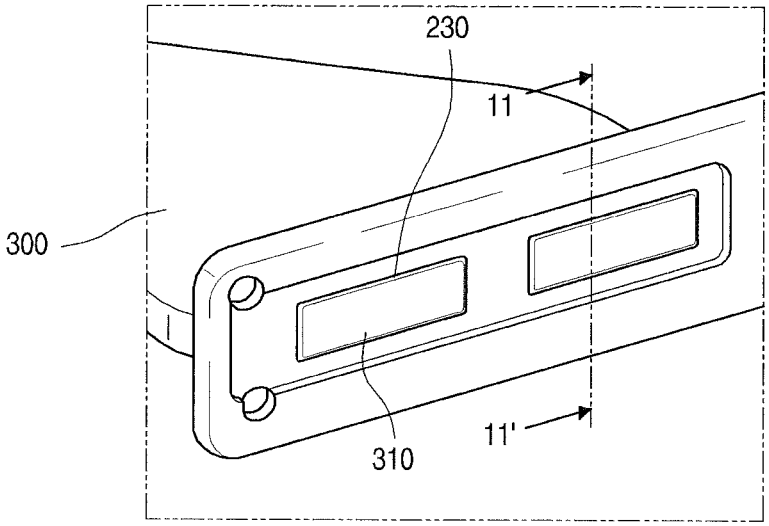
FIG. 10 is a partial perspective view illustrating a state where the hinge bracket and the hinge support are completely assembled with each other.
Figure 11:
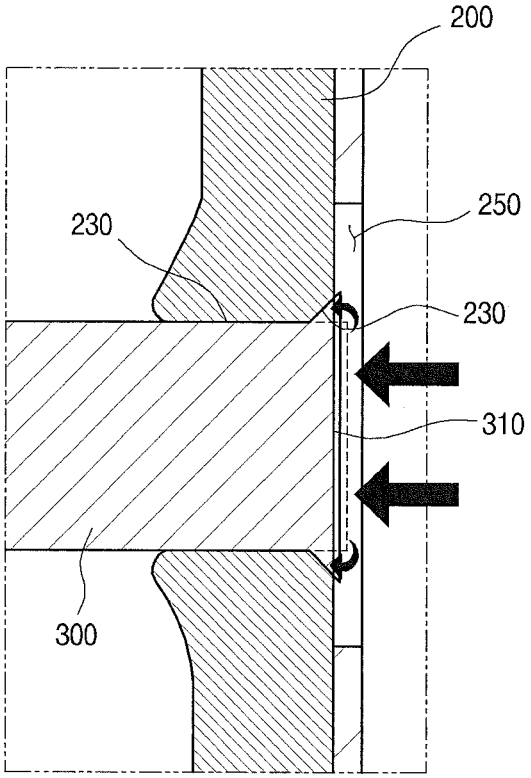
FIG. 11 is a cross-sectional view taken along line 11-11' of FIG. 10.

Further referring to a process (S300) of pressing and fixing the hinge bracket, the hinge bracket 300 may be inserted into the bracket support 240, and the insertion part 310 may be inserted into the coupling hole 230 to maintain the temporarily assembled state by using a mold or jig. Here, the rear end passing through the coupling hole 230 may be pressed and deformed by the press process or riveting process. Thus, as illustrated in FIGS. 10 and 11, the insertion part 310 and the coupling hole 230 may be closely attached to each other without forming a gap therebetween.

In detail, the rear end of the insertion part 310 that are temporarily assembled may be exposed backward through an outlet of the coupling hole 230. Here, when the rear end of the insertion part 310 is pressed by the press or riveting process, the rear end of the insertion part 310 may be deformed and thus closely attached toward an inclined part 231 of an outlet of the coupling hole 230. Since the insertion part 310 is deformed and closely attached, the insertion part 310 and the coupling hole 230 may be more firmly coupled to each other to prevent the gap from occurring therebetween.

In the state where the hinge support 200 and the hinge bracket 300 are completely fixed to each other, the hinge support 200 and the hinge bracket 300 may be disposed perpendicular to each other. The portion at which outer surfaces of the hinge support 200 and the hinge bracket 300 contact each other may be rounded or inclined by the bracket support 240. As described above, in the state where the hinge support 200 and the hinge bracket 300 are completely assembled with each other, surface treatment such plating or printing may be performed on surfaces of the hinge support 200 and the hinge bracket 300.

Further referring to a process (S400) of performing the surface treatment, when the surface treatment is performed on the hinge support 200 and the hinge bracket 300, since the assembly gap or edge is not formed on the portion at which the hinge support 200 and the hinge bracket 300 contact each other, an occurrence of the defects due to the assembly gap or edge that is formed when the surface treatment is performed may be prevented.

Further referring to a process (S500) of assembling the hinge pin, after the surface treatment is completed, the hinge pin 400 may be coupled to the hinge bracket 300. To achieve this, the hinge pin 400 can be inserted into and fixed to the pin insertion hole 320. Also, the hinge pin 400 exposed to a lower side of the pin insertion hole 320 may be fixed to the hinge bracket 300 within the bracket recess part 330 by the calking or welding.

When the mounting and surface treatment of the hinge pin are completed, the assembly of the hinge 100 may be completed. In this state, to install the hinge 100, the hinge 100 may be disposed on a front surface of the cabinet 10, and then, the fastening member 500 may be coupled to the main fastening hole 210 and the sub fastening hole 220 to fix the hinge 100. Also, after the hinge 100 is fixed and mounted, a hinge shaft disposed on a lower end of the door 20 and the hinge pin 400 may be coupled to each other.

As described above, when the mounting of the hinge 100 and the assembly of the door 20 are completed, the hinge 100 may support the door 20 at the lower portion of the door 20. Therefore, the door 20 may be rotatably mounted on the cabinet 10 by the hinge 100.

In the hinge for the refrigerator and the method for manufacturing the same according to one implementation, the hinge may be provided by coupling the hinge support and the hinge bracket which are manufactured by using the press processing. Also, in the hinge support, the front surface of the bracket support having a volume corresponding to the support recess part may protrude when the press processing is performed. When the hinge bracket is coupled, the bracket support may surround and support the end of the hinge bracket.

Thus, the hinge may be doubly supported by the supporting structure between the bracket support and the hinge bracket in addition to the coupling structure between the insertion part and the coupling hole to stably support the heavy door.

Also, since the bracket support can be naturally formed without performing a separate molding process while the hinge support is molded, the processing complexity may be reduced to improve productivity.

Also, since the bracket support has the rounded or inclined outer surface, the gap occurring in the coupling portion when the hinge support and the hinge bracket are coupled to each other may be minimized, thereby realizing an elegant outer appearance. In addition, when the surface treatment such as the plating and painting is performed, it may prevent the painting failure from occurring at the gap or edge at which the hinge support and the hinge bracket contact each other.

Also, the inclination part may be disposed on the outlet of the coupling hole. Thus, when the rear end of the insertion part is pressed to deform the insertion part in the state where the insertion part is inserted, the inclination part and the rear end of the insertion part, which is defaulted, may be closely attached to each other.

Thus, the occurrence of the gap between the coupling hole and the insertion part may be prevented to provide the more strong coupling structure between the hinge support and the hinge bracket by the adhesion structure between the inclination part and the insertion part.

Also, since the insertion part and the coupling hole are disposed inside the support recess part, and the rear end of the insertion part does not further protrude from the support recess part after the rear end of the insertion part is deformed, avoiding space may be provided to prevent the hinge from interfering with the cabinet when the hinge is mounted on the cabinet, thereby allowing a more accurate mounting the hinge.

Also, since the pin insertion hole to which the hinge pin is coupled is disposed inside the bracket recess part, and the coupling of the hinge pin through the calking or welding is performed inside the bracket recess part, a separate protruding structure may not be provided outside the bracket recess part.

Therefore, even though the other door is disposed under the hinge, the hinge may not interfere with the other door to improve the manipulation of the door and reduce the defect rate of the refrigerator.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hinge for a refrigerator, the hinge comprising:

a hinge support configured to be mounted on a front surface of a cabinet of the refrigerator, the hinge support having a plate shape and defining a coupling hole;

a hinge bracket comprising an insertion part configured to be inserted into the coupling hole, the hinge bracket being coupled to the hinge support along a longitudinal direction of the hinge support; and a hinge pin that is configured to mount to the hinge bracket, and that is configured to allow a door of the refrigerator to rotate about the hinge pin, wherein:

the hinge support includes a bracket support that at least partially surrounds the coupling hole and protrudes from a front surface of the hinge support, the bracket support being configured to provide support to the hinge support;

the hinge support defines a support recess part that is recessed into a rear surface of the hinge support that is opposite of the front surface of the hinge support that includes the bracket support;

the coupling hole is defined within the support recess part; and an outlet of the coupling hole includes an inclined part that is inclined around an inner circumference of the coupling hole, the outlet of the coupling hole opening toward and being exposed to the support recess part.

2. The hinge according to claim 1, wherein the hinge support is made of metal and formed by press processing; and wherein the support recess part is molded at the same time as the press processing of the hinge support such that the support recess part has a recessed volume corresponding to a protruding volume of the bracket support.

3. The hinge according to claim 1, wherein, based on the insertion part being inserted into the coupling hole, the insertion part protrudes from the outlet of the coupling hole.

4. The hinge according to claim 1, wherein the bracket support has an outer surface that is inclined or rounded.

5. The hinge according to claim 1, wherein the bracket support defines a space in which an end of the hinge bracket is accommodated.

6. The hinge according to claim 1, wherein the bracket support gradually decreases in thickness as the bracket support extends in a protruding direction associated with the bracket support.

7. The hinge according to claim 1, wherein:

the hinge support defines a fastening hole through which a fastening member is configured to pass through;

a tapered part having an inner diameter that gradually decreases from an inlet to an outlet and is disposed on an inner circumferential surface of the fastening hole; and a seating surface having an inclination corresponding to the tapered part and is provided on the fastening member.

8. The hinge according to claim 7, wherein the fastening hole comprises:

a main fastening hole disposed on one side of the bracket support; and a sub fastening hole disposed on each of upper and lower sides of the bracket support.

9. The hinge according to claim 1, wherein the hinge bracket defines a pin insertion hole into which the hinge pin is configured to be inserted from an upper side of the pin insertion hole; and wherein a bottom surface of the hinge bracket defines a bracket recess part recessed to be disposed inside the pin insertion hole.

10. A refrigerator comprising:

a cabinet;

one or more doors; and a hinge, wherein the hinge comprises:

a hinge support configured to be mounted on a front surface of the cabinet, the hinge support having a plate shape and defining a coupling hole;

a hinge bracket comprising an insertion part configured to be inserted into the coupling hole, the hinge bracket being coupled to the hinge support along a longitudinal direction of the hinge support; and a hinge pin that is configured to mount to the hinge bracket, and that is configured to allow one of the one or more doors to rotate about the hinge pin; and wherein:

the hinge support includes a bracket support that at least partially surrounds the coupling hole and protrudes from a front surface of the hinge support, the bracket support being configured to provide support to the hinge support;

the hinge support defines a support recess part that is recessed into a rear surface of the hinge support that is opposite of the front surface of the hinge support that includes the bracket support;

the coupling hole is defined within the support recess part; and an outlet of the coupling hole includes an inclined part that is inclined around an inner circumference of the coupling hole, the outlet of the coupling hole opening toward and being exposed to the support recess part.

11. The refrigerator according to claim 10, wherein the hinge support is made of metal and formed by press processing; and wherein the support recess part is molded at the same time as the press processing of the hinge support such that the support recess part has a recessed volume corresponding to a protruding volume of the bracket support.

12. The refrigerator according to claim 10, wherein, based on the insertion part being inserted into the coupling hole, the insertion part protrudes from the outlet of the coupling hole.

* * * * *